United States Patent [19]

Bätza et al.

[11] Patent Number: 4,710,203

[45] Date of Patent: Dec. 1, 1987

[54] ELECTROSTATIC PRECIPITATOR ELECTRODE

[75] Inventors: Willi Bätza, Offenbach; Werner Rösch, Oberursel, both of Fed. Rep. of Germany

[73] Assignee: Metallgesellschaft Aktiengesellschaft, Frankfurt, Fed. Rep. of Germany

[21] Appl. No.: 818,126

[22] Filed: Jan. 10, 1986

[30] Foreign Application Priority Data

Jan. 16, 1985 [DE] Fed. Rep. of Germany ..... 3501155

[51] Int. Cl.[4] ..... B03C 3/04; B03C 3/41; B03C 3/47

[52] U.S. Cl. ..... 55/2; 29/825; 55/137; 55/141; 55/151; 55/154; 428/683

[58] Field of Search ..... 55/2, 137, 150, 151, 55/154, 141, 145, 101; 29/592 R, 825, 879, 885; 428/683

[56] References Cited

U.S. PATENT DOCUMENTS

| | | | |
|---|---|---|---|
| 1,801,515 | 4/1931 | Marshall | 55/154 X |
| 2,034,278 | 3/1936 | Becket et al. | 428/683 |
| 2,054,405 | 9/1936 | Becket et al. | 428/683 |
| 3,819,985 | 6/1974 | Dusevoir | 55/151 X |
| 3,831,351 | 8/1974 | Gibbs et al. | 55/151 X |
| 4,119,765 | 10/1978 | Pinnow et al. | 428/683 |
| 4,213,766 | 7/1980 | Wyatt | 55/2 |

FOREIGN PATENT DOCUMENTS

| | | | |
|---|---|---|---|
| 623661 | 7/1961 | Canada | 55/154 |
| 159861 | 12/1980 | Japan | 55/150 |
| 37061 | 4/1981 | Japan | 55/151 |

OTHER REFERENCES

"Lukens Stainless-clad Steels", Luken Steel Co., Coatesville, Pa. 1947. Form No. 389-5-47. Copy in 428/683.

*Primary Examiner*—Kathleen J. Prunner
*Attorney, Agent, or Firm*—Karl F. Ross; Herbert Dubno

[57] ABSTRACT

A dry-operating electrostatic precipitator, especially for the cleaning of steel-making converter gases in which pyrophoric dust may deposit on electrodes of the electrostatic precipitator, has these electrodes composed of structural steel clad with corrosion-resistant steel.

1 Claim, 3 Drawing Figures

ELECTROSTATIC PRECIPITATOR ELECTRODE

FIELD OF THE INVENTION

Our present invention relates to electrostatic precipitator electrodes and, more particularly, to corona and collecting electrodes for an electrostatic precipitator and to an electrostatic precipitator incorporating same.

BACKGROUND OF THE INVENTION

An electrostatic precipitator generally comprises, within the housing which is traversed by a dust-laden gas, arrays of corona-discharge electrodes, frequently referred to only as corona electrodes or discharge electrodes, in appropriate frames, flanked by dust-collecting electrodes of sheet or strip construction upon which the dust particles collect when a high voltage direct current source applies an electrostatic potential across the corona and collecting electrodes.

In principle, the electrostatic precipitator, by reason of the corona discharge at the discharge electrodes, charges the particles of dust with a polarity corresponding to that of the corona electrodes, whereupon the dust particles are attracted to and deposit upon the collecting electrodes. From time to time the collecting electrodes may be rapped to dislodge the collected dust and cause it to deposit in a bin or hopper from which the dust can be removed.

Such rappers are generally provided on dry-operated electrostatic precipitators, wet-operated precipitators frequently utilizing a liquid to carry off the collected dust.

The operation of dry-process electrostatic precipitators for the cleaning of exhaust gases from steel-making converters must often be interrupted because the corona electrodes fail by scaling after a relatively short time even though the gas temperature is usually not higher than 150° C. to 250° C.

Investigations have shown that this result may be due to a smoldering of pyrophoric dust which has been deposited. It here may be noted that such pyrophoric dust, while tending primarily to deposit upon the collecting electrodes may also deposit to some extent to the corona electrodes should the dust have been oppositely charged.

Such smoldering on both electrodes may give rise to local temperatures in excess of 600° C. so that, under the action of this smoldering, oxide layers on the electrodes which one normally would expect to have a protective effect, tend to spall off, especially when the electrodes are cleaned by rapping blows. Such rapping blows may be applied to the corona electrodes as well as the collecting electrode.

The spalling and scale formation is most noticeable on the corona electrodes which are held in frames, primarily because of the small ratio of cross section to surface area, is present but less in extent on the collecting electrodes, and is generally not observed on the tensioning frames which consist of tubes or the like having comparatively thick walls.

Since the corona electrodes are maintained under tension and are subjected to severe mechanical stresses, it is not possible to use corona electrodes which consist of nonscaling materials generally because these are incapable of resisting the mechanical stresses which are encountered in electrostatic precipitators and have a higher coefficient of thermal expansion than the conventional structural steels from which the tensioning frame may be made.

Consequently, under the conditions previously described, the expansion of the corona electrodes with heating may exceed that of the frames and as a result the corona electrodes could relax and could readily deform from their strict rectilinear tensioned conditions. Under the influence of the gas flow, oscillations might be generated in the bowed corona electrodes and the spacing between these electrodes and the collecting electrodes would fluctuate so that local regions of increased voltage gradient might be established to the detriment of efficient separation. Uncontrolled motion of corona electrodes in the context of an electrostatic precipitator generally cannot be tolerated.

Furthermore, relaxed or loose corona electrodes cannot have dust efficiently dislodged therefrom by rapping blows to the frame. Because of dust accumulations on the corona electrodes, efficiency of separation falls further.

The obvious solution to this problem is to construct both the tensioning frames and the corona electrodes spanning same of the same nonscaling materials. However, this is not practical in most cases for mechanical reasons. Tensioning frames of nonscaling materials not only are expensive because of the materials which are used, but also because of the difficulty in fabrication and assembly.

OBJECTS OF THE INVENTION

It is the principal object of the present invention to provide an improved electrostatic precipitator whereby the drawbacks of earlier electrostatic precipitators can be avoided and particularly which can eliminate the effect of pyrophoric dust collection on either the corona electrodes or the collector electrodes or both, at reasonable cost and without fabrication and assembly difficulties.

Another object of this invention is to provide an improved method of making an electrostatic precipitator whereby the aforedescribed drawbacks are avoided.

It is also an object of this invention to provide an improved method of operating an electrostatic precipitator.

SUMMARY OF THE INVENTION

These objects and others which will become apparent hereinafter are attained, in accordance with our present invention in an electrostatic precipitator for the dry-process recovery of pyrophoric dusts from a gas stream and of the construction described generally above wherein the corona electrodes, or the collector electrodes or both consist of an ordinary high tensile strength steel clad on surfaces exposed to the gases and dust in the electrostatic precipitator with facings consisting essentially of a corrosion-resistant steel selected from the group which consists of:

(A) Titanium of niobium stabitized steel with 10 to 18% by weight chromium, up to 0.1% by weight carbon, up to 1.0% by weight silicon, up to 1% by weight manganese, the balance being iron and unavoidable impurities which do not affect the properties of the composition.

(B) Titanium or niobium stabilized steel with 16 to 20% by weight chromium 7 to 12% by weight nickel, up to 0.1% by weight carbon, up to 1% by weight silicon, up to 21% by weight manganese, the balance being iron and unavoidable impurities, and (C) A steel with 26 to 28% by weight chromium, 4 to 5% by weight nickel, 1.3 to 2% by weight molybdenum, up to 2% by weight manganese, up to 0.1% by weight carbon, the balance being iron and unavoidable impurities.

Preferably the electrode elements of the present invention are composed of sheet metal having the corrosion-resistant steel cladding on opposite broad faces of the ordinary steel on facings on each side, each amount to 8 to 12% of the total thickness (e.g. 1 to 2 mm) of the sheet metal elements. Sheet metal elements for corona electrodes normally have a thickness of 1.5 to 2 mm while the sheet metal elements for the collecting electrodes can have a thickness of 1.15 to 1.4 mm. Sheet metal which can be fabricated according to the invention into corona and collecting electrodes is marketed under the name Platinox by Klöckner-Werke AG, Germany.

In the method aspects of the invention, the aforementioned clad sheet metal is formed into corona and/or collecting electrodes in an electrostatic precipitator and the latter is operated for the dry separation of pyrophoric dusts, especially from steel-making converters.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
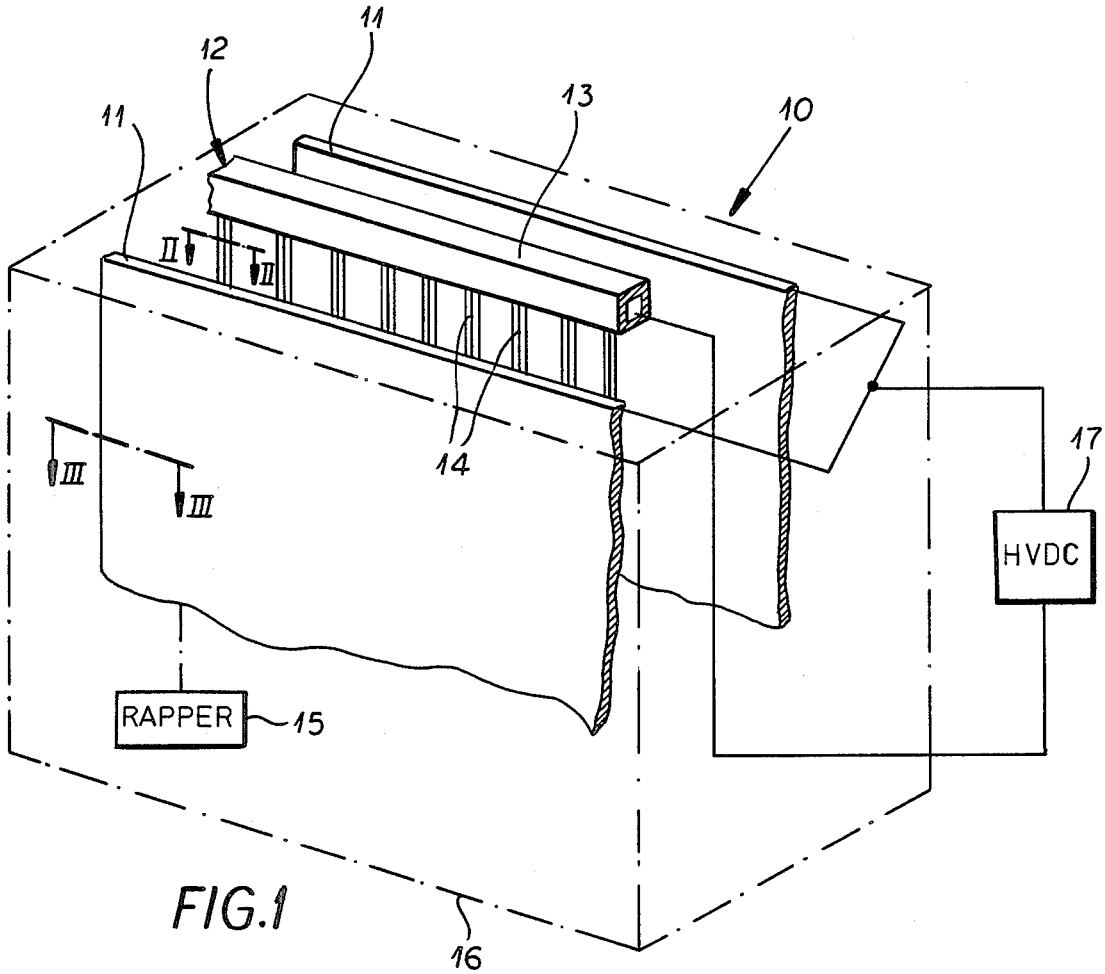
FIG. 1 is a diagrammatic fragmentary and perspective view of a portion of an electrostatic precipitator in accordance with the invention.

In FIG. 1 we have shown an electrostatic precipitator 10 which may be connected in the gas-cleaning line of a steel-making converter and comprises a housing enclosing a plurality of arrays of corona electrodes 14 (only one array being shown) in respective frames 12 consisting of tubular bars 13 of the usual frame steel. The corona electrode arrays and frames alternate with collecting electrodes 11, only two of which have been diagrammatically shown. The collecting electrodes are here represented as flat sheets although normally they would be constructed each from a set of interfitting sheet metal strips. A rapping device 15 is connected to the electrodes to dislodge dust which falls into the hopper 16. The electrostatic field is applied by the high voltage DC source 17.

Figure 2:
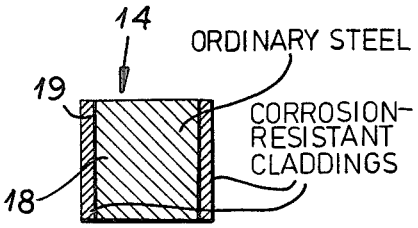
FIG. 2 is a section taken along the line II—II of FIG. 1.
Figure 3:
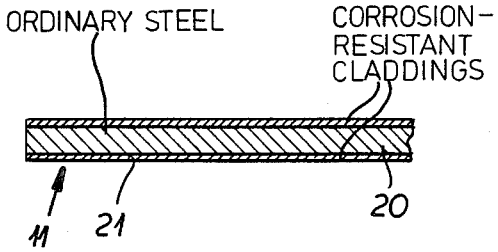
FIG. 3 is a section taken along the line III—III thereof.

As can be seen from FIG. 2, the corona electrodes 14 may consist of ordinary corona electrode steel cores 18 provided with one of the corrosion-resistant claddings 19 previously described as compositions A, B or C.

Similarly, the sheet metal cladding electrodes 11 each consist of a core 20 of ordinary collecting electrode steel provided with claddings 21 of one of the compositions A–C, previously described.

In an electrostatic precipitator for collecting dust from the exhaust gas of a steel-making converter, 20% of the corona electrodes of the first collecting field had failed after 700 operating hours. The same collecting field was then provided with new corona electrodes consisting of an equal number of corona electrodes composed of the ST 37 (German Industrial Standard DIN 17006) steel and corona electrodes of ST 37 steel clad with one of the compositions A–C which all acted equivalently, in a thickness of a 9% of the overall thickness of the strip per cladding or facing.

After 700 operating hours, all of the electrodes consisting of the ST 37 steel showed strong scaling and 20% of these electrodes had failed. By contrast, all corona electrodes of the composition A of the cladding showed substantially no scale and scale was not even observed in an appreciable amount in cut edges where the core steel was exposed by cutting the corona electrodes from clad sheet.

The thermal expansion was found to depend essentially only on the core material which also accounts for about 80% of the thickness and all corona electrodes were found to be even more tightly held in the frame than was the case when a test was run using corona electrodes composed fully of the material of the cladding composition.

The cladding can be applied by any commercial cladding process, e.g. as utilized in the production of the Platinox mentioned previously. The clad sheet material can be processed with the same ease as conventional steel and is only about 50% more expensive, which is not significant in face of the advantages achieved.

Failure of collecting electrodes by scaling, although less frequent than with corona electrodes, also indicates that the collecting electrodes may be effectively replaced by the clad steel composition. it may be noted that with collecting electrodes, local smoldering occurs more frequently but this is not as great a problem because the larger cross sectional area of the collecting electrodes allows heat dissipation at a greater rate so that temperatures in excess of 600° C. do not occur at all or occur only relatively infrequently. It also is possible that initially formed oxide layers are held more firmly on the collecting electrodes because of the greater area than on the corona strips. However collecting electrodes are usually thinner and thus might have a greater tendency to scale through so that they too are economically composed of a clad sheet metal of the invention.

A comparison of costs of an array of corona electrodes having a given size and consisting (a) of conventional sheet metal elements (ST 37), (b) in accordance with the invention of clad elements, or (c) of a complete assembly including tensioning frames made of nonscaling material capable of resisting the mechanical stress encountered, and used the costs of (a) as unity, shows b=1. to 1.2 and c=2.5 to 3.5.

We claim:

1. A method of operating an electrostatic precipitator for the removal of pyrophoric dust from a gas, comprising the steps of:

(a) forming corona-discharge electrode assemblies by tensioning corona-discharge electrode strips each composed of a sheet steel core clad on opposite sides with a corrosion-resistant steel and cut from sheet metal having an overall thickness of 1.5 to 2 mm and a cladding thickness of 8 to 12% of the overall thickness, in a frame, said corrosion-resistant steel cladding being resistant to spalling induced by pyrophoric reaction of deposits on said electrodes and selected from the group which consists of:

($a_1$) titanium or niobium stabilized steel with 10 to 18% by weight chromium, up to 0.1% by weight carbon, up to 1.0% by weight silicon, up to 1% by weight manganese, the balance being iron and unavoidable impurities which do not affect the properties of the composition, ($a_2$) titanium or niobium stabilized steel with 16 to 20% by weight chromium, 7 to 12% by weight nickel, up to 0.1% by weight carbon, up to 1% by weight silicon, up to 2% by weight manganese, the balance being iron and unavoidable impurities, and ($a_3$) a steel with 26 to 28% by weight chromium, 4 to 5% by weight nickel, 1.3 to 2% by weight molybdenum, up to 0.1% by weight carbon, up to 2% by weight manganese, the balance being iron and unavoidable impurities;

(b) juxtaposing said assemblies with collector electrodes; and (c) electrostatically precipitating pyrophoric dust by electrostatically energizing said electrodes and passing said dust between said collector electrodes and said corona-discharge electrodes at a temperature of substantially 150° C. to 250° C.

* * * * *